US005400553A

United States Patent [19]

Brennan

[11] Patent Number: 5,400,553

[45] Date of Patent: Mar. 28, 1995

[54] CELL CONSTRUCTION FOR A CORRECTIONAL FACILITY

[76] Inventor: James J. Brennan, P.O. Box 50007, Columbia, S.C. 29250

[21] Appl. No.: 88,176

[22] Filed: Jul. 7, 1993

[51] Int. Cl.[6] ..... E04H 3/08

[52] U.S. Cl. ..... 52/106; 52/79.9; 52/145; 52/202; 52/220.5; 52/270; 52/220.1

[58] Field of Search ..... 52/106, 220.1, 79.9, 52/250, 270, 202, 145, 220.5, 220.7; 49/171, 463; 439/202-209

[56] References Cited

U.S. PATENT DOCUMENTS

| | | |
|---|---|---|
| 344,644 | 6/1986 | Erb . |
| 469,635 | 2/1992 | Hale . |
| 1,611,261 | 12/1926 | Youngblood . |
| 3,722,152 | 3/1973 | Schlatter et al. . |

*Primary Examiner*—Carl D. Friedman
*Assistant Examiner*—Robert J. Canfield
*Attorney, Agent, or Firm*—Michael A. Mann

[57] ABSTRACT

A correctional facility cell pair includes a cell from attached to a cell wall. The cell front has a frame, a pair of doors, and a pipe chase. The pipe chase has both a removable panel and a hinged hatch. The hatch is used for routine access to the interior of the chase; the panel can be removed by unbolting from inside the chase for easier access to the chase interior when more extensive work in the chase is required. Manufacture of the cell front as a unit simplifies the construction of the cell pair because the order of installation of cell walls and cell front is no longer critical as it is in current design; the present invention allows either to be installed first. The, cell front is preferably made of channel steel with sound attenuating material placed inside the channels.

24 Claims, 2 Drawing Sheets

FIG 1 — PRIOR ART
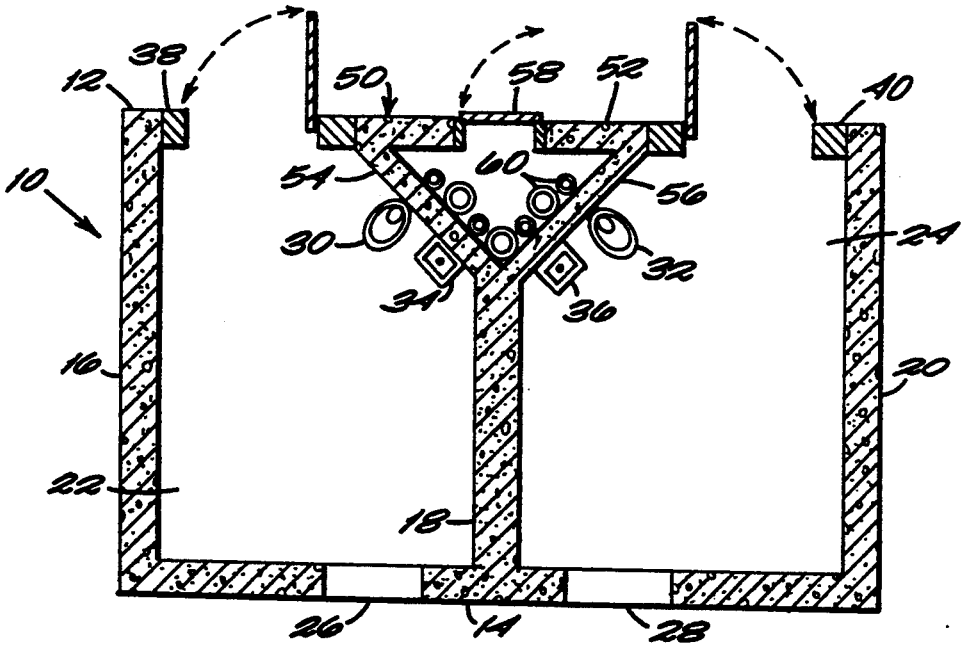
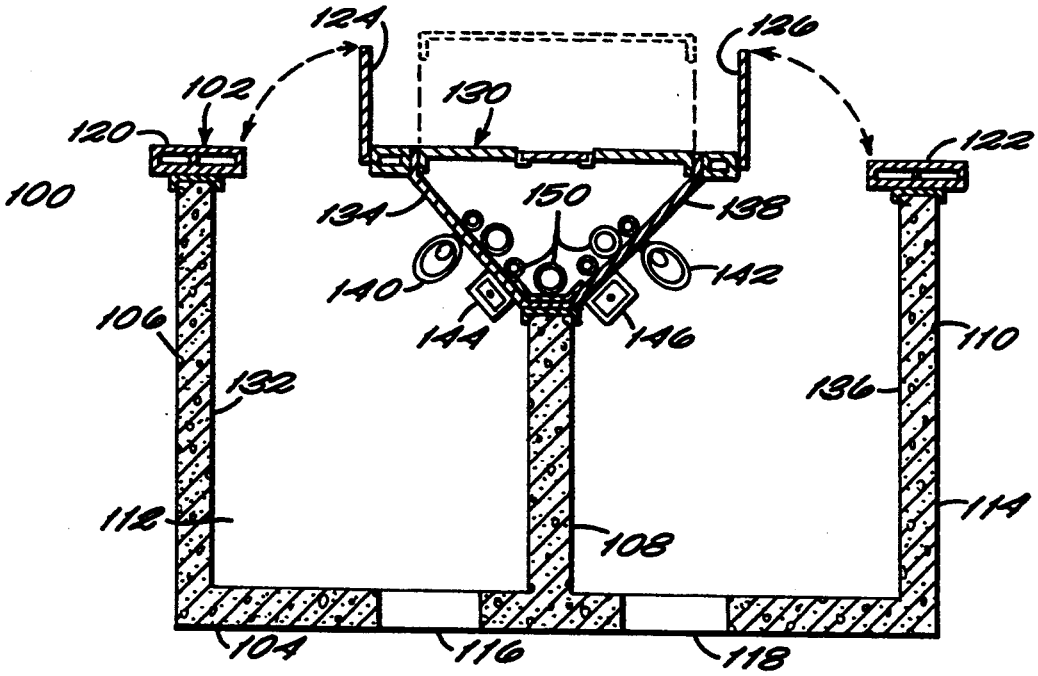
FIG 2

CELL CONSTRUCTION FOR A CORRECTIONAL FACILITY

BACKGROUND OF THE INVENTION

1. Field of the Invention:

The present invention relates to cells for housing inmates in a correctional facility. More particularly, the present invention is a new design for the front of a cell to, facilitate constructing and operating the cell.

2. Discussion of the Background of the Invention:

People who are believed to have violated a law and who are being detained pending trial, or those who are serving a sentence for having been convicted of violating laws, are housed in cells in correctional facilities. Sometimes others are housed in cells, too. For example, those who, because of a mental condition, might be harmed by others or who might cause harm to others, may be housed in cells. As used herein, then, the term "cell" means living quarters for one or more individuals whether those individuals are locked within the cell or not.

A cell is usually a single room in an array of rooms running horizontally and possibly also vertically. Typically, adjacent cells share a common wall and a pipe chase; the floor of one cell above may serve as the ceiling of a cell below. Cells typically include minimal utilities such as a commode, a sink, vents for heating and air conditioning, electrical outlets and fixtures, and perhaps communications equipment such as an intercom speaker.

The utilities in the interior of a cell typically include piping and cabling that run through a wall of the cell and enter a pipe chase, which is a conduit into which the piping: and cabling from a number of cells in a group of cells is directed for connection to sewage systems, service water, electrical sources, air conditioning ducts, and so forth, as appropriate.

Correctional facilities are usually constructed and operated at public expense, being part of the criminal justice system. Oftentimes, these facilities are subject to overcrowding when there are an insufficient number of cells for the number of inmates to be housed. Overcrowding is a serious problem and is alleviated by one or more of three possible solutions: releasing inmates before they have served their full sentences, eliminating jail time from the sentences of some convicted law breakers, or building more correctional facilities. The last of these three options depends on public funding from taxes. For many reasons, tax dollars must be marshaled and efficiently used. Building cost-effective jail cells will provide more cells than otherwise.

In recent years billions of dollars have been spent for the construction of new prison and jail facilities throughout the United States. Common denominators in these construction projects include constant pressure to reduce construction budgets and complete the facilities in shorter periods of time. The design and construction industries have responded to these pressures by providing a variety of cell types, both conventional and modular. Conventional types of cell are constructed in the field, and have walls made of poured-in-place concrete, precast concrete, or reinforced masonry. Modular cells are manufactured in a plant, complete with floors, walls, ceilings, and sometimes furnishings. The completed cells are then transported to the construction site as a packaged unit. Each of these approaches offers distinct advantages, but each carries limiting factors as well.

Masonry cells utilize concrete block walls filled with concrete grout, reinforced by vertical and horizontal steel bars placed at varying intervals depending on the level of security that is to be achieved. This approach to cell construction has historically been among the most cost-effective in terms of initial construction costs. If the construction project is staffed and scheduled properly, low cost cells can be produced within a reasonable time frame, however, the availability of skilled masons is a limiting factor. Because the security components—doors, access hatches, locks, and so forth—are assembled by numerous individuals in the field, quality control becomes extremely important. Many masonry construction projects encounter difficulties due to lack of coordination for the setting of reinforcing steel and wall anchors for doors, windows, and mechanical penetrations. The highest concentration of items for which coordination is required occurs; at the cell front and mechanical chase portion of the cells. Masonry walls must be constructed, and the hatch and doors secured in place. Windows, locks, conduits in the interior of the pipe chase and other security devices must also be installed. The inability to properly plan and execute the various stages of the project can result in significant delays in project completion. Lower construction costs may be achieved, but at the risk of manpower or scheduling delays.

Concrete floors, walls, and ceilings of cells may be poured-in-place. Here, the required anchors for the door and window openings themselves can be set within the formwork prior to each concrete pour. Many projects utilize a tunnel-form system, which allows a number of cells to be poured at the same time. After a group of cells is poured, the formwork is dismantled and reset for continued production of additional cells. This system produces a monolithic security wall.

When a concrete cell front and chase are formed by this method, the forming procedure becomes more complex and finished products such as security hollow metal frames must be placed within the concrete forms. Although far from impossible, it is more difficult to ensure proper alignment and protection of finished surfaces than for the masonry type of construction described above. In addition, the metal parts must be derailed to stop the flow of concrete through openings such as lock pockets and bolt holes. Sometimes, asphalt coatings are used to protect the metal pans. Poured-in-place construction, like masonry construction, relies on the timely delivery of security hollow metal products in order to proceed with construction activity. The poured-in-place system offers a higher assurance of the integrity of security walls, but at a slight premium in construction costs.

Modular concrete cell units offer the security provided by monolithic concrete cells, with the increased quality control obtainable at an off-site manufacturing plant. Such units are cast at a manufacturing plant, provided with furnishings and fixtures if desired, and then shipped to the project construction site. Constructing these units at a remote plant offers some very distinct advantages. The units may be assembled by trained craftspersons who specialize in cell construction. Enclosed plants offer protection from the weather, which helps both the quality of the product and the production schedule. Coordination with other trades and products is accomplished at the plant rather than in the field.

Often, the end product may achieve a higher level of quality than similar items produced in the field.

A limiting factor to this approach is construction costs. For example, more material is used than for conventional on-site construction because many of the common walls between cells are duplicated. Duplication of structural systems can occur if the cell modules are not load-bearing. Transportation costs can vary widely from project to project. This approach offers a higher level of quality control than field construction, but often at significantly increased costs.

Modular cells constructed of metal panels are also available. Units consisting of floors, walls and ceilings, complete with fixtures and furnishings are available. As with concrete modular cells, them may be duplication of materials, particularly if the cell units are not incorporated as part of the structural system of the building. This material excess, along with transportation costs, can lead to a premium in construction costs.

Each of these approaches to cell construction offers some desirable advantages, but each has limitations with respect to time, money or quality. Masonry or concrete walls erected in the field have proven to be extremely cost effective. However, difficulties arise in coordinating construction and assembly of the cell front and chase components. Modular cell manufacturers have shown that coordination and quality issues can be dealt with very effectively in the plant, but only at a significant cost premium.

There is a great and continuing need for designs for jail cells that are less expensive to construct and operate but still satisfy the overall criteria of securely housing inmates.

SUMMARY OF THE INVENTION

According to its major aspects and briefly stated, the present invention is a cell for use as living quarters. The cell has a perimeter that defines an interior with a major portion and a minor portion. The major portion is deemed by walls and the minor portion, by a cell front. In the cell are utilities suitable and sufficient for the intended use of the cell. The cell front includes a frame with a door, or other means connected to said frame for accessing the cell interior, and a pipe chase. Inside the pipe chase is piping that communicates with the utilities interior to the cell. The pipe chase is covered by a panel that is attached in such a way that it can be removed from the front of the chase for access to its interior. The panel itself carries a hatch for access to said interior of said pipe chase. The hatch, being smaller than the panel and hingedly attached rather than bolted to the frame, serves as a door for routine access, but when more extensive access is required, such as during construction, the panel is unbolted and removed to expose the full interior of the chase.

The cell front is an important feature of the present invention. In particular, the front is a single fabricated piece that includes the door, the door frame and the pipe chase. As will be described in more detail in the Detailed Description of Preferred Embodiments, the cell front simplifies constructing the cell and therefore reduces both the cost of construction and the time to complete construction. Because a cell is made in part of metal components fabricated away from the facility location and in part of ceramic material such as cinder blocks or concrete formed on location, which must be joined to the metal components, coordinating the attachment of these two pans has herebefore been a difficult scheduling concern. The present cell front eliminates the need to coordinate the timing of attachment of these two parts.

Another important feature of the present invention is the panel. During construction and sometimes during operation of the facility, workers need to have access to the confined and crowded interior of the pipe chase for extended periods of time or for more extensive repair operations. Removal of the panel makes it much easier to have access to the pipe chase interior than that provided by the hatch alone.

These and other features and advantages of the present invention will be apparent to those skilled in the an of correctional facility cell design from a careful reading of the following Detailed Description of Preferred Embodiments accompanied by the drawings.

BRIEF DESCRIPTION OF THE DRAWINGS

In the drawings,

FIG. 1 is a cross-sectional view of a prior art cell pair,

FIG. 2 is a cross-sectional view of a cell pair according to a preferred embodiment of the present invention;

DETAILED DESCRIPTION OF PREFERRED EMBODIMENTS

Figure 5:
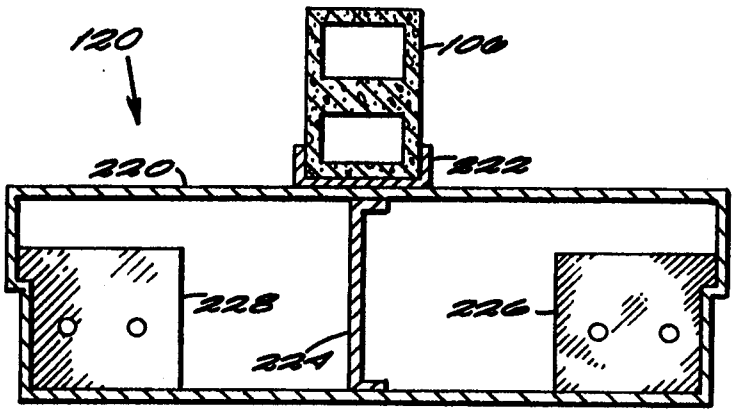
FIG. 5 is a detailed view of the lock jamb of the unit of FIG. 2.

A typical, prior art cell pair 10 is shown in FIG. 1. Cell pair 10 has a front 12, a rear wall 14, and side walls 16, 18, 20 defining a pair of adjacent cells 22, 24. Rear wall 14 may include window openings 26, 28. Cells 22, 24 may include pre-installed fixtures such as commodes 30, 32 and wash bowls 34, 36. Cells 22, 24 have doors 38, 40, respectively. Cell pair 10 includes a shared pipe chase 50, defined by a front wall 52 and side walls 54, 56. Side walls 54, 56 may be formed at angles to side wall 18, as shown in FIG. 1, to form a generally triangular enclosure. Chase 50 has a metal, preferably stainless steel access hatch 58, and contains water and sewage pipes, ventilation ducts, electrical wiring, and heating and air conditioning ducts, indicated generally by reference character 60.

Modular cell pair units such as unit 10 may be combined to provide a cell block of any desired size. For example, side walls 16, 20 may serve as the side walls of adjacent cell units (not shown). The floors of cells 22, 24 may serve as the ceilings of adjacent, lower cells, and the ceilings of cells 22, 24 may be the floors of the cells above.

According to a preferred embodiment of the present invention, the straight walls, floors and structural system of a cell are produced in the field, either in masonry or concrete. The cell front and pipe chase, the source of most of the scheduling and quality control problems found in field construction, are designed as non-load-beating components and are manufactured off-site. This consolidated approach captures the advantages of both types of construction by redefining the zone between conventional field construction and modular construction.

Referring now to FIG. 2, there is shown a cell pair 100 according to a preferred embodiment of the present invention. Cell pair 100 has a front wall 102, a rear wall 104, and side walls 106, 108, 110 defining a pair of adjacent cells 112, 114. Rear wall 104 may include window openings 116, 118. Front wall 102 includes two lock jambs 120, 122 affixed to side walls 106, 110, respectively, two doors 124, 126, and mechanical or pipe chase 130. Cell 112 has a perimeter with a major portion 132 defined by walls 104, 106, 108, and a minor portion 134 defined by chase 130, lock jamb 120 and door 124. Similarly, cell 114 has a perimeter with a major portion 136 defined by walls 104, 108, 110, and a minor portion 138 defined by chase 130, lock jamb 122 and door 126.

Cells 112, 114 contain commodes 140, 142 and wash bowls 144, 146, respectively. Pipe chase 130 contains water and sewage pipes connected to fixtures 140, 142, 144, 146, ventilation ducts, electrical conduit, and heating and air conditioning ducts, indicated generally by reference character 150.

Figure 4:
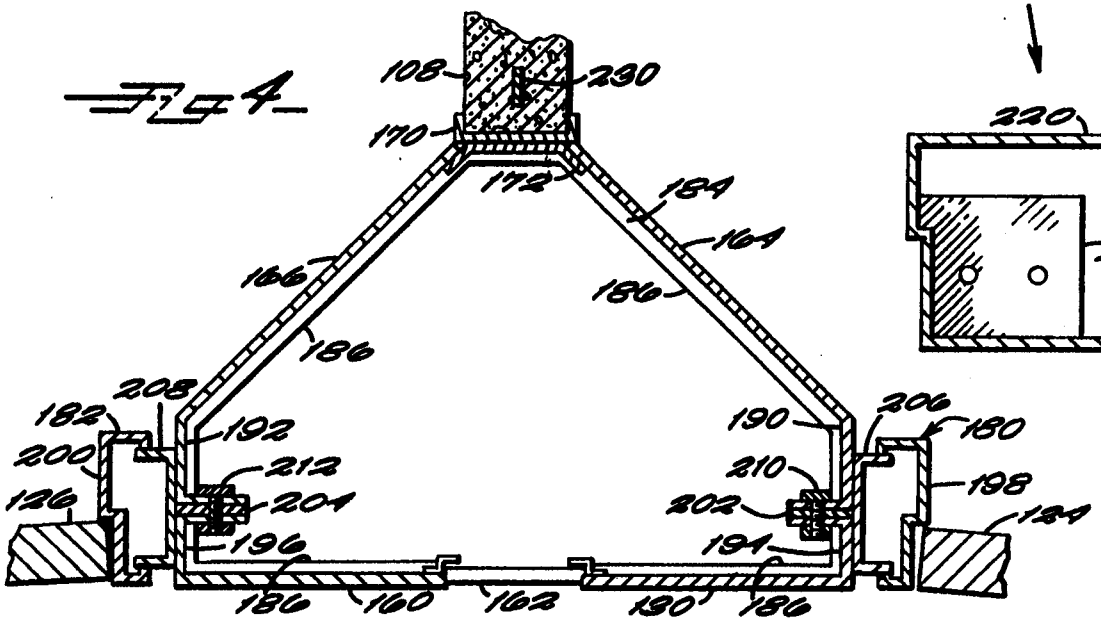
FIG. 4 is a detailed view of a portion of the pipe chase of the cell pair of FIG. 2.
Figure 3:
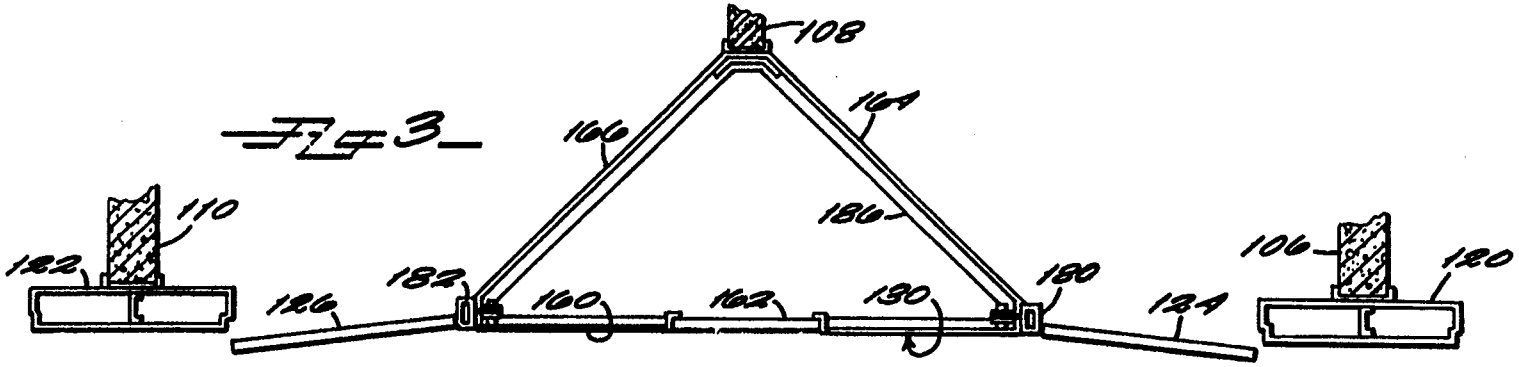
FIG. 3 is a detailed view of a portion of the cell front of the cell pair of FIG. 2.

As best seen in FIGS. 3 and 4, pipe chase 130 has a front panel 160 with an access hatch 162 hingedly attached thereto, and two side walls 164, 166. Panel 160 and walls 164, 166 form a generally triangular enclosure. This arrangement is preferred for modular construction, however, pipe chase 130 may assume some other cross-sectional shape without departing from the spirit of the present invention.

Turning now to FIG. 4, side walls 164, 166 are attached to a "U"-shaped beam 170, and reinforced with a reinforcing member 172. Beam 170 and reinforcing member 172 are rigidly affixed to side walls 164, 166, preferably by welding and most preferably by stitch welding. Panel 160 and side walls 164, 166 are attached to door jambs 180, 182. Doors 124, 126 are attached to door jambs 180, 182 by suitable hinges (not shown). Jambs 180, 182 and lock jambs 120, 122 define the frames of doors 124, 126, respectively.

If desired, the interior of pipe chase 130 may be provided with sound deadening material 184. Panel 160 and walls 164, 166 may be reinforced with channel stiffeners, indicated generally as reference character 186, welded or otherwise attached to the walls. Stiffeners 186 may be approximately "V"-shaped or "U"-shaped metal channels, approximately parallel and spaced at suitable intervals along panel 160 and walls 164, 166. Stiffeners 186 are preferably formed with a continuous angle at the base, and a continuous adjustable angle at the top of pipe chase 130, to allow for minor adjustments in assembling a block of cell units such as pair 100. Stiffeners 186 may be aligned horizontally or vertically along the walls.

Side walls 164, 166 terminate in "L"-shaped portions 190, 192, respectively. Similarly, front 160 has opposing "L"-shaped end portions 194, 196. Door jambs 180, 182 include hinge jambs 198, 200 with extending portions 202, 204. Jambs 198, 200 are welded or otherwise attached to "U"-shaped beams 206, 208, respectively. Portion 202 is bolted to portions 190, 194 by a bolt 210, and portion 204 is bolted to portions 192 and 196 by a bolt 212, as shown in FIG. 4.

A detail view of lock jamb 120, attached to side wall 106, is shown in FIG. 5. Lock jamb 120 has a generally rectangular frame 220 attached to a "U"-shaped member 222 by welding or other suitable means. A channel stiffener 224 is welded to frame 220. Jamb 120 contains two lock boxes 226, 228 for pocket or other suitable types of lock. Thus, lock 226 secures door 124 to cell 112, while lock 228 secures the door to an adjacent cell (not shown).

The interior of pipe chase 130 may be accessed by unlocking and removing access hatch 162, or, alternatively, by removing panel 160. Panel 160 is preferably a floor-to-ceiling panel, and is detached from chase 130 by removing hatch 162, then unbolting portions 194, 196. When panel 160 is removed, the entire interior of chase 130 is exposed for ease of inspection and maintenance. However, bolts 210, 212 are not accessible from the cells 112, 114, precluding inmate access to the interior of chase 130.

Cell front 102 and pipe chase 130 are made of metal plate, preferably channel steel and more preferably the type of stainless steel known in the art as security hollow metal. Steel plates, reinforcing channels, connection devices such as wall anchors, metal doors, door frames and locks suitable for use with the present invention are available from a number of manufacturers. Pipe chase 130 may be constructed with pre-installed security hardware, mechanical ductwork and electrical conduit, conduit for door controls and security systems, and safety devices such as smoke detectors or sprinkler piping. Alternatively, some or all of these may be installed once cell pair 100 is assembled at the construction site. If desired, channel reinforcing may be provided at openings in walls 164, 166 for connection of toilet and lavatory fixtures 140, 142, 144, 146 in the field. Pipe chase 130, doors 124, 126, and the other metal components of cell pair 100 may be primed or finish painted at the manufacturing plant, or painted after installation.

Preferably, front 102—the part of cell pair 100 best suited for off-site manufacturing—is assembled at a manufacturing plant. The coordination and quality control required for manufacturing of the components of front 102 are thus shifted to the plant, while those components most suited for construction in the field are constructed them.

The design of front 102 anticipates that the balance of cell pair 100 will be of concrete or masonry. Front 102 is non-load-beating, therefore not an integrated part of the structural system of the building of which unit 100 forms a part.

In virtually every present-day cell construction method, the triangular mechanical or pipe chase (chase 50 in FIG. 1) between two adjoining cells is enclosed prior to the installation of ductwork, plumbing and conduit to be located within the chase. The interior of the chase is accessible via access panels such as panel 58, but the restricted work environment makes installation of needed mechanical and electrical items difficult. This also inhibits the ability to properly inspect the completed systems by construction professionals, owners, and building officials.

In contrast, cell front 102—with pipe chase 130—may be installed either before or after completion of adjacent building construction, that is, construction of walls 104, 106, 108, 110. Front 102 may be set in place, and adjoining walls and roof slabs constructed around it, anchored by wall anchors such as anchor 220 (FIG. 4). Alteratively, construction of the walls, floors and roof may be completed first and front 102 installed at a later date. Because front 102 may be installed whenever convenient, all metal components of pair 100 are removed from the general construction critical path. As discussed above, the entire interior of pipe chase 130 may be accessed by unlocking and removing access hatch 162, then removing panel 160.

Because front 102 is manufactured off-site, the level of quality control and the coordination of related products needed for assembling front 102 are significantly enhanced. This work is performed by trained craftspersons, often working specifically in the production of cell components. Responsibility for the cell front is shifted to the manufacturing plant, where the ability to achieve more thorough coordination and higher quality control is more readily available in plant construction rather than field applications. Cell pair 100 therefore combines the advantages of on-site construction and off-site manufacturing. Maximum efficiency of masonry and poured-in-place concrete construction can be achieved, because assembly of the cell front-one of the more problematic portions of the cell—is transferred to other subcontractors.

If desired, the assembled cell fronts may be loaded into enclosed tractor-trailers as manufacturing is completed. The trailers provide secure, weathertight protection for storage of the items at the manufacturing plant. Purchasers may be offered the option of moving loaded trailers to the construction site when needed, or advance shipment and storage at the construction site in the trailer containers. The latter approach allows the general contractor maximum flexibility in construction scheduling, while protecting the finished products from weather and related construction activities.

The present invention ensures that field construction is accomplished more efficiently, since the metal components of cell pair 100 can be installed at any convenient time during construction. Improved quality control is accomplished by manufacturing the critical components of pair 100 at an off-side plant. Thus, the invention addresses three major areas of concern—cost, time and quality—in a manner that provides the most scheduling freedom to the general contractor. This lower costs, ensures shorter construction schedules, and expands quality control for the construction of cells.

It will be apparent to those skilled in the art that many modifications and improvements may be made to the preferred embodiments described above without departing from the spirit and scope of the present invention, defined by the appended claims.

What is claimed is:

1. A cell serving as living quarters for a person, said cell having a perimeter defining an interior, said perimeter having a major portion and a minor portion, said cell comprising:

walls defining said major portion of said perimeter of said cell;

utilities in said interior of said cell; and a front attached to said walls and defining said minor portion of said perimeter of said cell, said walls and said front together forming said perimeter of said cell, said front including a frame, means operatively connected to said frame for accessing said interior of said cell, and a pipe chase attached to said frame and having an interior for housing piping communicating with said utilities, said pipe chase having a panel removably attached to said pipe chase so that said panel may be removed for access to said interior of said pipe chase, and a hatch carried by said panel for access to said interior of said pipe chase.

2. The cell as recited in claim 1, wherein said walls are made of a ceramic and said front is made of metal.

3. The cell as recited in claim 1, wherein said walls are made of a material selected from the group consisting of cinder blocks and concrete and said front is made of channel steel.

4. The cell as recited in claim 1, wherein said panel is attached to said pipe chase from said interior of said pipe chase so that said panel may be detached only from said interior of said chase.

5. The cell as recited in claim 1, wherein said front further includes means for attenuating sound transmission through said front.

6. The cell as recited in claim 1, wherein said pipe chase and said frame are integrally attached.

7. The cell as recited in claim 1, wherein said front is made of channel steel.

8. The cell as recited in claim 1, wherein said walls are made of a material selected from the group consisting of cinder blocks and concrete.

9. The cell as recited in claim 1, wherein said walls are made of a ceramic material.

10. The cell as recited in claim 1, wherein said front is made of metal.

11. A cell front for use with a cell serving as living quarters for a person, said cell having an interior, a perimeter with a major portion and a minor portion, said cell including walls defining said major portion of said perimeter of said cell, said cell including piping in communication with utilities within said cell, said cell front comprising:

a frame;

means operatively connected to said frame for accessing said interior of said cell when said frame is attached to said cell: and a pipe chase attached to said frame for housing said piping communicating with said utilities, said pipe chase having a panel removably fastened to said frame so that said panel may be removed for access to said pipe chase, and a hatch hingedly carried by said panel for access to said pipe chase.

12. The cell front as recited in claim 11, wherein said pipe chase and said frame are integrally attached.

13. The cell front as recited in claim 11, wherein said cell front is made of channel steel.

14. The cell front as recited in claim 11, further comprising means carried by said frame for attenuating sound transmission through said front.

15. The cell front as recited in claim 11, wherein said front is made of channel steel and said front further comprises means for attenuating sound transmission through said front.

16. The cell front as recited in claim 11, wherein said pipe chase has an interior, and wherein said panel is attached to said pipe chase from said interior so that said panel may be detached only from said interior of said chase.

17. The cell front as recited in claim 11, wherein said call front is made of metal.

18. A cell front for use with a cell serving as living quarters for a person, said cell having a perimeter with a major portion and a minor portion, said cell having piping that communicates with utilities for said cell, said cell front comprising:

a frame;

a pipe chase attached to said frame for housing said piping;

a panel removably fastened to said frame so that said panel may be removed for access to said pipe chase; and a hatch hingedly carried by said panel for access to said pipe chase.

19. The cell front as recited in claim 18, wherein said pipe chase and said frame are integrally attached.

20. The cell front as recited in claim 18, wherein said cell front is made of channel steel.

21. The cell front as recited in claim 18, further comprising means carried by said frame for attenuating sound transmission through said cell front.

22. The cell front as recited in claim 18, wherein said front is made of channel steel and said cell front further comprises means for attenuating sound transmission carried within said cell front.

23. The cell front as recited in claim 18, wherein said pipe chase has an interior, and wherein said panel is attached to said pipe chase from said interior so that said panel may be detached only from said interior of said chase.

24. The cell front as recited in claim 18, wherein said cell front is made of metal.

* * * * *